US005595785A

United States Patent [19]

Hindagolla et al.

[11] Patent Number: 5,595,785

[45] Date of Patent: Jan. 21, 1997

[54] ORIFICE PLATE FOR AN INK-JET PEN

[75] Inventors: Suraj L. Hindagolla, Corvallis; Glen A. Hopkins, Philomath, both of Oreg.; Howard H. Taub, San Jose; Si-Ty Lam, Pleasanton, both of Calif.; Paul H. McClelland, Monmouth; James S. Aden, Corvallis, both of Oreg.

[73] Assignee: Hewlett-Packard Company, Palo Alto, Calif.

[21] Appl. No.: 424,971

[22] Filed: Apr. 18, 1995

Related U.S. Application Data

[62] Division of Ser. No. 724,648, Jul. 2, 1991, Pat. No. 5,434,606.

[51] Int. Cl.[6] ..... B05D 1/02; B05D 1/32

[52] U.S. Cl. ..... 427/271; 427/282; 427/309; 427/421

[58] Field of Search ..... 427/271, 282, 427/421, 309, 272; 347/45

[56] References Cited

U.S. PATENT DOCUMENTS

| | | | |
|---|---|---|---|
| 4,226,896 | 10/1980 | Coburn et al. | 427/34 |
| 4,252,848 | 2/1981 | Datta et al. | 428/64 |
| 4,343,013 | 8/1982 | Bader et al. | 347/45 |
| 4,391,843 | 7/1983 | Kaganowicz et al. | 427/41 |
| 4,549,188 | 10/1985 | Shackleton | 346/1.1 |
| 4,643,948 | 2/1987 | Diaz et al. | 428/422 |
| 4,678,680 | 7/1987 | Abowitz | 427/38 |
| 4,751,532 | 6/1988 | Fujimura et al. | 346/140 |
| 4,775,594 | 10/1988 | Desjarlais | 428/421 |
| 4,801,955 | 1/1989 | Miura et al. | 347/45 |
| 4,829,319 | 5/1989 | Chan et al. | 346/1.1 |
| 4,890,126 | 12/1989 | Hotomi | 346/140 |
| 5,121,134 | 6/1992 | Albinson et al. | 346/1.1 |

FOREIGN PATENT DOCUMENTS

| | | | |
|---|---|---|---|
| 0359365 | 7/1989 | European Pat. Off. | B41J 2/005 |
| 55-65564 | 5/1980 | Japan | B41J 3/04 |
| 55-107481 | 8/1980 | Japan | B41J 3/04 |
| 56-21862 | 2/1981 | Japan | B41J 3/04 |
| 58-92569 | 6/1983 | Japan | B41J 3/04 |
| 60-184852 | 9/1985 | Japan . | |
| 63-22660 | 1/1988 | Japan | B41J 3/04 |

OTHER PUBLICATIONS

European Search Report, EP 92 30 6034 Jan. 6, 1993.

Patent Abstracts for Japan, vol. 4, No. 108 (M–24) (590) 5 Aug. 1980 for JP–A–55 065 564 (S. Matsumoto) 17 May 1980.

IBM Technical Disclosure Bulletin vol. 15, No. 5 Oct. 1972, New York, USA, pp. 1418–1419, J. J. Kotla et al.: "Bimetallic Differential–Wetting Piezoelectric Printing Device".

Patent Abstract of Japan vol. 12, No. 332 (M–738) (3179) 8 Sep. 1988 for JP–A–63 095 951 (S. Kamanaka) 26 Apr. 1988.

Patent Abstract of Japan vol. 12, No. 227 (M–713) (3074) 28 Jun. 1988 for JP–A–63 022 660 (M. Yasuhara) 30 Jan. 1988.

"Highly Non–Wettable Surfacs Via Polymer Vapor Depositoin," B. D. Washo, pp. 131–135, 1983. No dates provided.

"Durability of Surface Modification by Plasma Polymerization," Plasma Polymerization—H. Yasuda, Academic Press, Inc., 1985 pp. 345–355.

"Development of a High–Resolution Thermal Inkjet Printhead" Hewlett–Packard Journal, Oct., 1986, pp. 55–58.

"Highly Non–Wettable Surface of Plasma Polymer Vapor Deposition of Tetrafluorethylene" IBM Technical Disclosure Bullitin, Sep. 1983, 2 pages.

"High–Precision Plasma Processing In The Most Compact Module Ever", 800 Series Micro–Rie, Product Brochure, TECHNICS (with specifications).

*Primary Examiner*—Michael Lusignan
*Assistant Examiner*—Fred J. Parker

[57] ABSTRACT

Selected portions of the orifice plate surfaces are formed to have wetting and non-wetting surface characteristics for minimizing the accumulation of residual ink on the outer surface of the plate and for enhancing the flow of supply ink to the orifices of the plate.

8 Claims, 2 Drawing Sheets

ORIFICE PLATE FOR AN INK-JET PEN

CROSS REFERENCE TO RELATED APPLICATION

This is a divisional of application Ser. No. 07/724,648 filed on Jul. 2, 1991, now U.S. Pat. No. 5,434,606.

TECHNICAL FIELD

This invention pertains to orifice plates used with ink-jet pens.

BACKGROUND INFORMATION

Orifice plates are mounted to ink-jet pens and include orifices through which ink drops are expelled by any one of a number of drop ejection systems. One such system is known as the thermal type and includes a thin-film resistor that is intermittently heated for vaporizing a portion of ink near an adjacent orifice. The rapid expansion of the ink vapor forces a drop of ink through the orifice. A partial vacuum or "back pressure" is maintained within the pen to keep ink from leaking out of the orifices when the drop ejection system is inactive.

There may be several orifices formed in a single orifice plate, each orifice having an associated drop ejection system for supplying a drop of ink on demand as the ink-jet pen scans across a printing medium.

Some of the ink that is ejected through the orifice does not reach the printing medium (such as paper), and instead collects on the outer surface of the orifice plate (that is, the surface facing the printing medium). Some of this residual ink accumulates or puddles adjacent to the edge of the orifice and may alter the trajectory of the subsequently ejected drops, thereby reducing the quality of the printed image.

Residual ink on the outer surface of the orifice plate also tends to trap stray particles, such as paper fibers. The fibers may be held by the ink near the orifice to partially block the orifice and interfere with ink drop ejections. Further, residual ink on the orifice plate outer surface may collect near the orifice into a thin sheet that is in fluid communication with ink stored in a supply chamber that is just inside the orifice. As a result, a continuous ink path between the chamber and the outer surface of the orifice plate may be formed. The path promotes ink leakage through the orifice. Accordingly, the outer surface of an ink-jet pen orifice plate should be designed so that ink does not puddle in the vicinity of the orifice nor accumulate on the plate in an amount that traps fibers and facilitates leakage as mentioned above.

The inner surface of an orifice plate is exposed to the supply of ink. The ink flows over the inner surface to each orifice. Preferably, the inner surface of the orifice plate, including the portion defining the orifice, should facilitate the flow of ink from the supply through the orifice so that the drop ejection system receives a continuous and uniform flow of ink.

SUMMARY OF THE INVENTION

This invention is directed to an improved orifice plate for an ink-jet pen. The orifice plate has an outer surface that enhances pen performance by controlling the accumulation of residual ink on the outer surface of the plate so that the outer edges of the orifices are free of residual ink, and so that ink is readily removed from the outer surface. The inner surface of the plate facilitates ink flow to the orifices along the inner surface of the plate.

The invention is particularly concerned with controlling the wetting characteristics of the orifice plate surfaces to achieve the enhanced pen performance just mentioned. In one embodiment, the portion of the outer surface of the orifice plate that immediately surrounds the orifice is non-wetting with respect to the ink. Consequently, residual ink on this outer surface portion of the orifice plate beads up away from the edge of the orifice so as not to interfere with the trajectory of subsequently ejected drops. The remaining portion of the outer surface is wetting so that residual ink on the outer surface of the orifice plate will readily flow off the plate under the influence of gravity or a wiping mechanism.

As another aspect of this invention, the inside surface of the plate is treated to be a wetting surface with respect to the ink, thereby facilitating ink flow into and through the orifices.

As another aspect of this invention, each portion of the outer surface that surrounds the orifice has a narrow wetting part adjacent to the edge of the orifice, and a non-wetting part surrounding the wetting part. The wetting part permits residual ink that lands on the wetting part to migrate back into the orifice, thereby providing a substantially ink-free region between the orifice edge and the non-wetting part so that any ink beading on the non-wetting part is spaced away from the orifice edge by a distance sufficient to avoid interference with subsequently-ejected drops.

Also provided are methods for producing an orifice plate in accordance with the present invention.

FIGS. *3a–3f* depicts a series of cross-sectional views showing a preferred method for making an orifice plate in accordance with the present invention.

Figure 4:
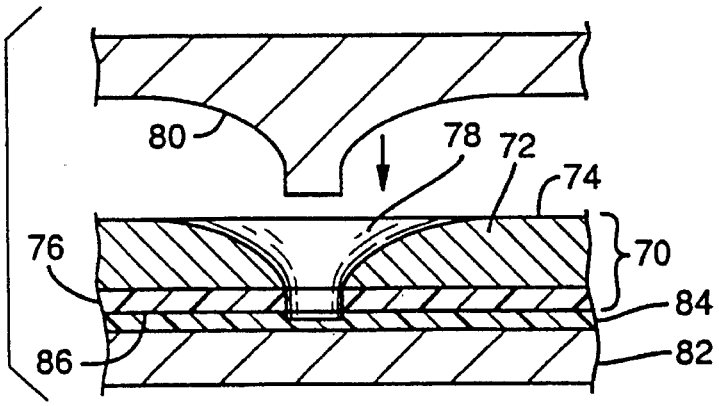

FIG. 4 is a diagram of an alternative method for making an orifice plate of the present invention.

DETAILED DESCRIPTION OF PREFERRED EMBODIMENTS

Figure 1:
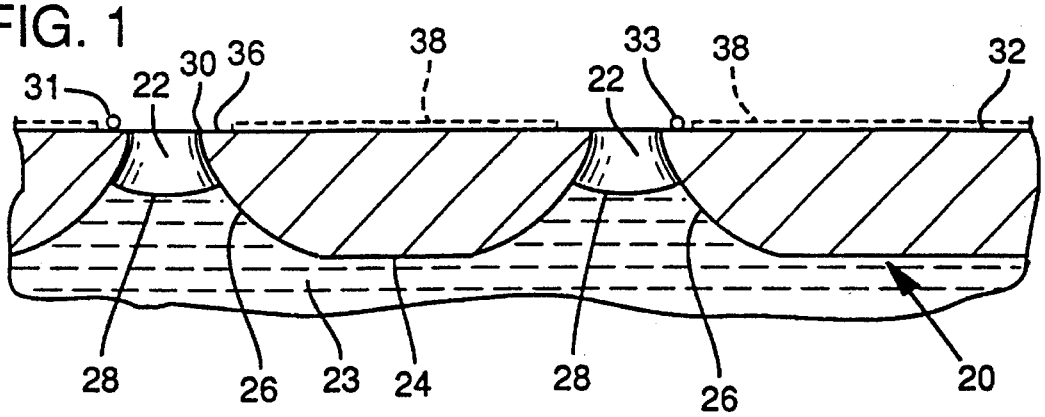
FIG. 1 is a diagram showing a side cross-sectional view of a portion of an orifice plate that is formed in accordance with the present invention.
Figure 2:
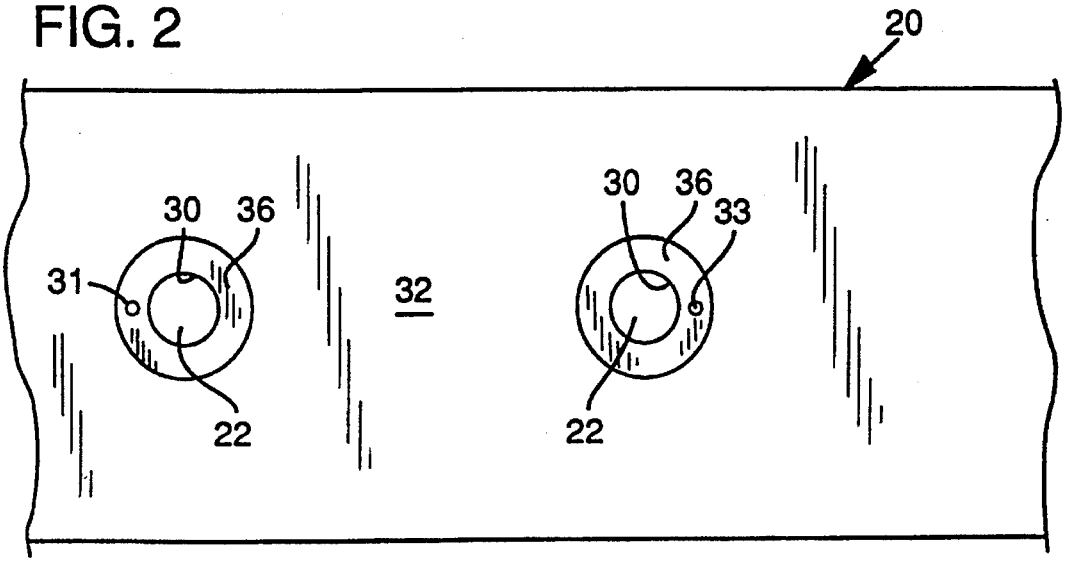
FIG. 2 is a top plan view of the orifice plate showing the outer surface thereof.

As shown in FIGS. 1 and 2, the present invention includes an orifice plate 20 for a conventional ink-jet pen. The orifice plate 20 may be a sheet of gold-plated nickel and constructed by conventional electroforming techniques. The plate 20 includes an array of orifices 22 (only two shown in the figures) through which ink drops are selectively propelled by known ejection means, such as provided by a thermal type ejection system mentioned above. The plate inner surface 24 includes somewhat funnel-shaped portions 26 that define each orifice 22.

Ink 23 is drawn by capillary force along the inner surface 24 of the plate 20 into each orifice 22. A partial vacuum or back pressure within the ink-jet pen keeps the ink from passing completely through the orifice in the absence of an ejecting force. Whenever drops of ink 23 are not being fired through the orifice 22, the ink resides within the orifice with a meniscus 28 (FIG. 1) just inside the outer edge 30 of the orifice 22.

The drop ejection system (not shown) is associated with each orifice 22 for selectively ejecting drops of ink through the orifice 22 to a printing medium, such as paper. The orifices 22 have been shown as generally funnel-shaped in section. It is understood, however, that the orifices may have any one of a variety of shapes.

Whenever an ink drop is ejected through an orifice 22, a trailing portion or "tail" of ink moves with the drop. A small amount of the ink tail may separate and land on the outer surface 32 of the plate 20 as an ink droplet. Two such residual ink droplets 31, 33 are shown in FIGS. 1 and 2.

As mentioned earlier, residual ink that collects on the orifice plate outer surface 32 near the edges 30 of the orifices 22 may contact subsequently ejected ink drops, thereby altering the trajectory of those drops, which reduces the quality of the printed image. Further, in the event that a substantial amount of residual ink accumulates on the orifice plate outer surface 32, a continuous liquid path between the ink 23 within the orifice 22 and the ink on the outer surface 32 may be formed, thereby facilitating leakage of the ink out of the orifice. Moreover, the residual ink on the outer surface 32 of the orifice plate 20 tends to trap minute particles, such as paper fibers, that can extend across and partly block the orifice 22, thereby interfering with the trajectory of subsequently-ejected drops.

The wetting characteristics of a surface may be "wetting" or "non-wetting." Non-wetting means that the surface energy of the surface is much less than that of the liquid (ink) that is in contact with the surface. A surface is considered non-wetting if the contact angle between the ink and the surface is greater than 70°. Ink tends to bead on non-wetting surfaces. A wetting surface (that is, with respect to the ink) has a contact angle less than 70°. Ink tends to spread across wetting surfaces.

In the present invention, the outer surface portion 36 that surrounds the orifice edge 30 is non-wetting with respect to ink and serves as a barrier to the development of the continuous liquid-path just mentioned. The remaining portion 38 (outlined with dashed lines in FIG. 1) of the orifice plate 32 is a wetting surface that permits the residual ink to readily flow (or be wiped) from the orifice plate outer surface 32, thereby avoiding the accumulation of a significant amount of residual ink on the outer surface 32.

Referring to FIG. 1, one technique for achieving the selected wetting characteristics just mentioned (i.e., either a wetting surface or a non-wetting surface) is described with respect to a gold-plated or nickel orifice plate 20. The outer surface 32 of orifice plates that are formed of nickel or gold-plated nickel are generally non-wetting with respect to the ink. Portions of the plate are, therefore, processed for changing selected surface portions to have the desired wetting characteristic.

In processing the plate, the annular surface portion 36 (FIG. 2) that surrounds each edge 30 of an orifice 22 is covered with a correspondingly shaped layer of exposed photoresist (not shown) that is applied by known means for serving as a mask for protecting the covered surface portion 36 from hereafter described plasma etching, thereby to maintain the non-wetting property of the surface portion 36.

With the exposed photoresist material covering the outer surface portions 36 that surround the orifices 22, the inside surface 24 and the remaining portion 38 of the outer surface 32 are plasma-etched to change those portions 24, 38 to be wetting. The dashed lines that illustrate the portion 38 of the outer surface 32 that is plasma etched (FIG. 1) appear raised relative to the annular portion 36 only for illustrative purposes; surface properties that define a non-wetting surface (annular portion 36) and a wetting surface (remaining portion 38) are microscopic.

Any number of techniques may be employed for altering the exposed surfaces 24, 38 of the orifice plate 32 so that those surfaces become wetting. In a preferred embodiment, the orifice plate, with photoresist material covering the outer surface portions 36, is placed within the vacuum chamber of a conventional plasma etching or reactive ion etching apparatus, such as manufactured by Technics of Dublin, Calif., and designated the 800 SERIES MICRO-RIE. The plate is exposed to oxygen, that is preferably applied at a pressure range of between 50 and 500 millitorrs and more preferably at 200 millitorrs. The power applied to the electrodes of the etching apparatus is preferably in a range of 5 to 500 watts and most preferably 100 watts. The orifice plate 20 is exposed to the plasma for approximately 5 minutes.

It can be appreciated that any of a number of combinations of parameters (pressure, power, and time) of the plasma etching process may be used to etch the exposed surfaces 24, 38. It is contemplated, therefore, that any of a combination of the parameters will suffice as long as the exposed surface portions (that is, the portions not covered with a layer of photoresist material) are wetting surfaces. Preferably, the contact angle of the wetting surface resulting from the plasma etching is between 20° and 50°.

After the plasma etching step, the photoresist material is removed from the outer surface portions 36. Accordingly, the surface portion 36 surrounding each orifice 22 is non-wetting.

As mentioned earlier, the effect of having a wetting inner surface 24 (including the inner surface portions 26 that define the orifices 22) is that ink 23 will readily flow into the orifices 22 to replace ink that is ejected from the orifices as the pen is operated. In the absence of a wetting inner surface 24, the flow rate of this replacement ink into the orifices is reduced, thereby reducing the frequency with which drops may be ejected from the orifices 22.

Wetting surface portions 38 on the outer surface 32 of the orifice plate 20 facilitate removal of residual ink from the outer surface 32. This removal may be by gravity, for instance, when the pen is operated with the outer surface 32 in a generally vertical plane. Other mechanisms, such as a wiper, may be employed for periodically wiping away the residual ink on the outer surface portion 38.

As shown in FIG. 1, the effect of the non-wetting surface portion 36 is to cause any residual ink droplets 31, 33 to bead on that surface away from the edge 30 of the orifice so that the residual ink 31, 33 does not interfere with (that is, contact) the drops that are later ejected from the orifices 22.

In instances where the residual ink droplets are generally larger than the width of the non-wetting surface portions 36, those droplets will contact the adjacent wetting surface portions 26, 38 that are inside of the orifice plate 22 or adjacent to the non-wetting portions 36. When such droplet contact occurs, the droplet will immediately flow to that surface portion 26 or 38 (that is, either back into the orifice or onto the wetting surface portion 38), thereby moving away from the edge 30 of the orifice 22. Whenever a residual ink droplet contacts and moves into the wetting surface portion 26 of the orifice from the non-wetting outer surface portion 36, that droplet will flow inwardly along the wetting surface portion 26 and join the stored ink 23.

Orifice plates constructed of material other than nickel or gold-plated nickel may be processed to have the differential wetting characteristics described above. For example, an orifice plate formed of polyimide (which material inherently has greater than a 70° contact angle) would be processed as described above to create the selected non-wetting surface portions and wetting surface portions.

FIG. 3 depicts the primary steps of constructing an alternative embodiment of an orifice plate 40. In this embodiment, the non-wetting surface is achieved by the spray-application of a non-wetting material over selected surface portions. The wetting property of selected surface portions is provided by plasma etching as described earlier. This alternative technique may be useful in instances where, for example, the surface of the orifice plate material (i.e., prior to processing) has an undesirable low contact angle, or the material changes from a non-wetting to a wetting surface as a result of use or environmental factors.

The orifice plate 40 depicted in FIG. 3 is electroformed by known means upon a mandrel 42. The orifice plate 40 is shaped as described with respect to the embodiment of FIG. 1, and includes an array of orifices 44 that extend from the inner surface 46 to the outer surface 48 of the plate 40.

Figure 3A:
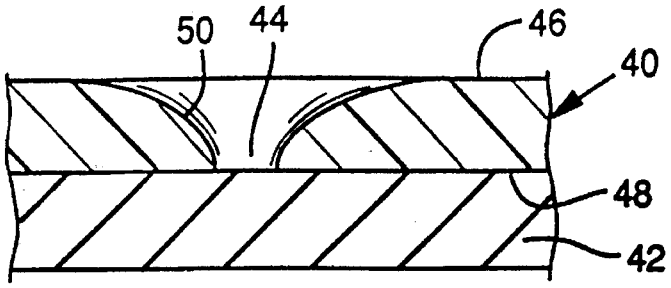

The plate 40 is electroformed onto the mandrel 42 with the outer surface 48 contacting the mandrel 42 (FIG. 3*a*). The exposed inner surface 46, including the inner surface portions 50 that define the orifices 44, is then plasma etched as described earlier to make that surface wetting.

Figure 3B:
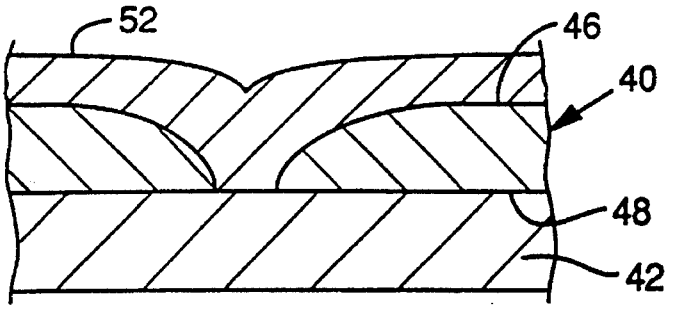

After the inner surface 46 is treated to have the wetting characteristic as just described, a removable mask 52 is electroformed over the inner surface 46 including the surface portions 50 that define the orifices 44 (FIG. 3*b*).

Figure 3C:
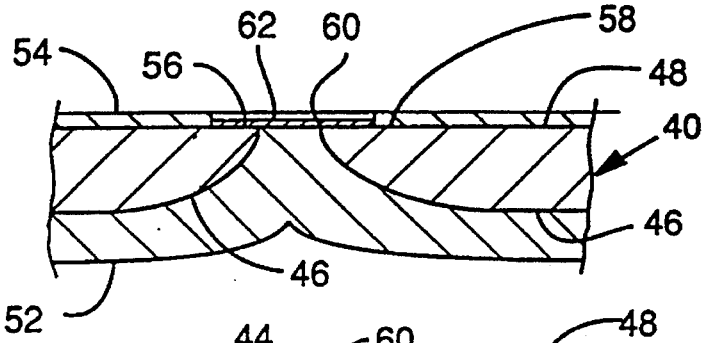

Once the mask 52 is formed, the orifice plate 40 is inverted, and the mandrel 42 removed to expose the outer surface 48 of the orifice plate. The outer surface 48 of the orifice plate is then plasma-etched as described above so that the outer surface 48 is provided with a wetting property. Thereafter, outer surface portions 58 that are to remain as wetting surfaces (that is, those portions corresponding to surface portions 38 in FIG. 1) are masked with photoresist 54 so that the outer surface portion 56 immediately surrounding the orifice edge 60 is exposed to receive the spray-applied non-wetting material 62 (FIG. 3*c*).

In the preferred embodiment, non-wetting material is a cross-linked silicone resin, such as the methyltrimethoxysilane manufactured by Dow Corning and designated Q1-2645. Preferably, the non-wetting material 62 is applied to provide a layer of between about 0.2μ and 2.0μ.

Figure 3D:
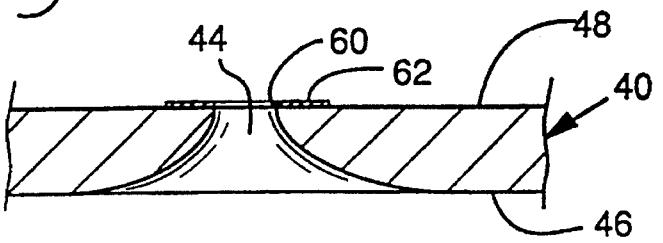

The mask 52 prevents the non-wetting material from being applied to the inner surface 46 of the orifice plate. Once the non-wetting layer 62 is cured, the mask 52 is removed and the portion of the non-wetting layer 62 that covers the orifice 44 is removed by suitable means, such as laser trimming, hydraulic shock, or plasma etching (FIG. 3*d*).

As another aspect of this invention, the non-wetting surface portion 68 that surrounds the orifice 44 may be formed a slight distance away from the edge 60 of the orifice so that any residual ink beads present on the non-wetting portion will be located far enough from the orifice edge 60 so that those beads will not interfere with ink drops ejected from the orifice. To this end, and with particular reference to FIGS. 3*e* and 3*f*, a part 64 of the outer surface 48 of the plate 40 immediately adjacent to the edge 60 of the orifice 44 is made to be wetting so that residual ink that lands on the wetting part 64 will migrate back into the orifice 44, thereby leaving a substantially ink-free region between the orifice edge 60 and an annular non-wetting surface part 68 that surrounds the wetting part 64 of the outer surface 48.

Figure 3E:
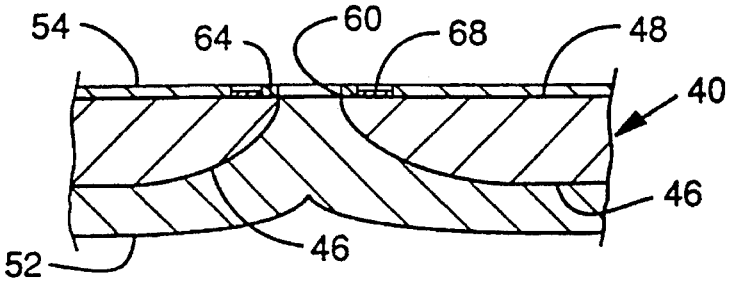

As shown in FIG. 3*e*, an orifice plate 40 having a wetting surface part 64 immediately adjacent to the edge 60 of the orifice 44 is constructed in accordance with the technique described with respect to FIGS. 3*a* and 3*b*, and by further applying a photoresist mask 54 to the plasma-etched (hence, wetting) outer surface 48, except for the annular portion 68 that immediately surrounds the wetting part 64, which annular portion is then sprayed with a thin layer of non-wetting material in a manner as described earlier with respect to FIG. 3*c*.

Figure 3F:
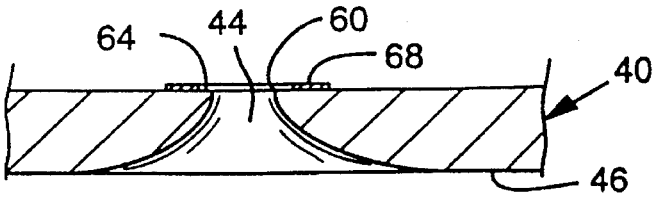

In a preferred embodiment, the distance between the edge 60 of the orifice and the nearest part of the annular non-wetting surface 68 is between about 30 and 80μ. After the non-wetting material is cured, the photoresist 54 is removed, thereby exposing the outer surface 48 of the orifice plate 40, including the wetting part 64 that surrounds the edge 60 of the orifice 44 (FIG. 3*f*).

It can be appreciated that an orifice plate having a wetting surface part immediately adjacent to the edge of an orifice, which part is surrounded by a non-wetting annular surface part, may be formed in accordance with the construction technique described with respect to the embodiment in FIG. 1. In this regard, the photoresist layer covering surface portion 36 (FIG. 1) may be spaced slightly away from (that is, radially outwardly from) the edge 30 of the orifice 22 to expose the part of the outer surface 32 that is adjacent to that edge 30 to the plasma-etching described earlier.

It is contemplated that the contact angle of orifice plate outer surface portions that are to remain non-wetting may be increased by the application of a fluorocarbon or silicon polymer layer via a conventional plasma polymerization technique. Portions of the outer surfaces that are to have low contact angles may be covered with a photomask prior to plasma polymerization. Upon completion of the plasma polymerization process, any polymer that may have formed on the inner surface of the plate may be removed by reactive ion etching.

FIG. 4 is a diagram of an alternative method for forming an orifice plate 70 in accordance with the present invention. The orifice plate 70 may comprise a base layer 72 having an inner surface 74 treated to be wetting. The base layer is bonded or otherwise attached to an outer surface layer 76. Preferably, the outer surface layer 76 has a non-wetting property. The base layer 72 may be formed of, for example, polyethylene terphthalate (PET), PETG, or a polycarbonate. The outer surface layer 76 may be formed of, for example, a fluorocarbon polymer such as manufactured under the trademark Teflon by DuPont, silicon rubbers, or silicon resin of sufficiently high contact angle.

The orifices 78 in the orifice plate 70 are formed by a die 80 that is pressed against a press plate 82 with the orifice plate 70 therebetween. Preferably, a thin layer 84 of a cushion material such as low-density polyethylene, or polyvinyl alcohol is placed between the orifice plate 70 and the press plate 82. The cushion layer 84 serves to keep the outer surface 86 of the outer surface layer 76 from protruding outwardly (downwardly in FIG. 4) in the region where the forming die shears through the layer 76 in forming the orifice 78.

After the orifice plate 70 is formed, the portion of the outer surface 86 surrounding the orifice 78 may be masked with photoresist material while the remaining non-wetting portion of the outer surface 86 is plasma-etched to impart a wetting surface property thereto for achieving the advantages described earlier.

The orifice plate 70 of FIG. 4 may, instead of being punched by the die 80 as described above, be cast in two layers upon a mandrel that is shaped substantially as the die of FIG. 4. Specifically, a base layer, such as that described with respect to base layer 72 of FIG. 4, is cast on the mandrel and later covered with an outer surface layer having (or later treated to have) a non-wetting characteristic.

While having described and illustrated the principles of the invention with reference to preferred embodiments and alternatives, it should be apparent that the invention can be further modified in arrangement and detail without departing from such principles. Accordingly, it is understood that the present invention includes all such modifications that may come within the scope and spirit of the following claims and equivalents thereof.

We claim:

1. A method of making an orifice plate having an orifice extending therethrough, the method comprising the steps of:

selecting an essentially planar substrate for an orifice plate, said essentially planar substrate having a first surface and a second surface, said first surface including a first portion having a wetting characteristic with respect to ink;

forming an orifice extending from said first surface of the orifice plate to said second surface in said orifice plate, said orifice and said first portion of said first surface joining to define an edge, said first portion of said first surface being adjacent to said edge, surrounding said orifice, and separated from said orifice by said edge;

surrounding said first portion of said first surface with a second portion of said first surface, said second portion given a non-wetting characteristic with respect to ink; and surrounding said second portion of said first surface with a third portion of said first surface said third portion of said first surface having a wetting characteristic with respect to ink.

2. The method of claim 1 wherein the step of surrounding said second portion comprises the step of etching said third portion of said first surface to provide said wetting characteristic.

3. The method of claim 1 wherein the step of surrounding said first portion comprises the step of spraying onto said first surface a material that has said first wetting characteristic.

4. The method of claim 3 wherein the step of surrounding said first portion comprises the step of masking said third portion of said first surface while said second portion of said first surface is sprayed to have said second wetting characteristic.

5. The method of claim 1 further comprising the step of masking said third portion of said first surface and said first portion of said first surface while said second portion of said first surface is sprayed to have the first wetting characteristic.

6. The method of claim 1 wherein said steps of surrounding said first portion of said first surface and surrounding said second portion of said first surface further comprise the steps of applying a photoresist mask to essentially all of said first surface except for said second portion of said first surface and applying a layer of non-wetting material onto said second portion of said first surface.

7. The method of claim 6 wherein said step of applying said layer of non-wetting material further comprises the step of applying said layer to a thickness of between 0.2μ and 2.0μ.

8. The method of claim 1 further comprising the steps of:

applying a mask to said second surface of said essentially planar substrate and to a surface which defines the orifice; and etching said first surface, thereby producing said first wetting characteristic with respect to ink.

* * * * *